US005344667A

United States Patent [19]

Seder

[11] Patent Number: 5,344,667

[45] Date of Patent: Sep. 6, 1994

[54] METHOD AND APPARATUS FOR MANUFACTURING SERPENTINE AVIONICS FLUORESCENT TUBES WITH ENHANCED UNIFORMITY OF LUMINANCE AND CHROMATICITY

[75] Inventor: Thomas A. Seder, Cedar Rapids, Iowa

[73] Assignee: Rockwell International Corporation, Seal Beach, Calif.

[21] Appl. No.: 21,375

[22] Filed: Feb. 23, 1993

[51] Int. Cl.[5] ..... B05D 5/06

[52] U.S. Cl. ..... 427/67; 427/66; 427/106; 427/110; 427/236; 427/427

[58] Field of Search ..... 427/66, 236, 427, 67, 427/110

[56] References Cited

U.S. PATENT DOCUMENTS

| | | | |
|---|---|---|---|
| 2,336,946 | 12/1943 | Marden et al. | 427/67 |
| 3,303,042 | 2/1967 | Reed et al. | 427/67 |
| 4,597,984 | 7/1986 | Jansma | 427/67 |

*Primary Examiner*—Janyce Bell

*Attorney, Agent, or Firm*—Gregory G. Williams; M. Lee Murrah; H. Fredrick Hamann

[57] ABSTRACT

A method and apparatus for uniform application of a coating of fluorescent phosphors to tubes that have been bent into a serpentine shape, which includes dragging a hose and phosphor spray nozzle through the bends of the serpentine tube, thereby depositing a phosphor layer throughout the serpentine tube.

5 Claims, 1 Drawing Sheet

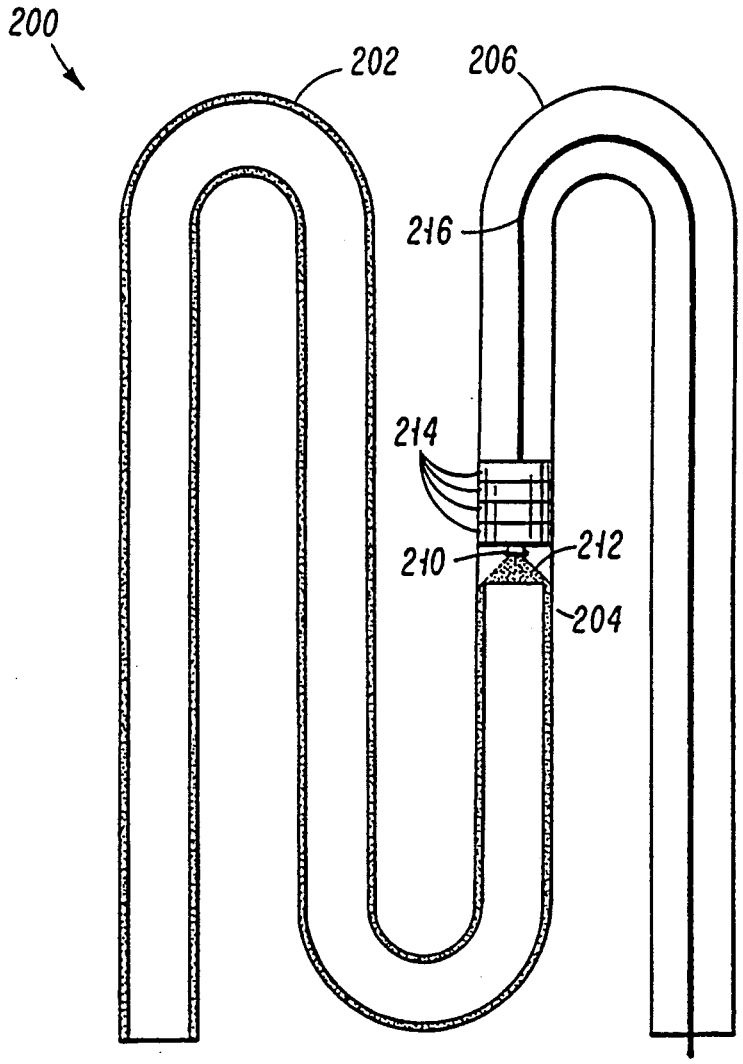
200
202
206
216
214
210
212
204

METHOD AND APPARATUS FOR MANUFACTURING SERPENTINE AVIONICS FLUORESCENT TUBES WITH ENHANCED UNIFORMITY OF LUMINANCE AND CHROMATICITY

CROSS REFERENCE TO RELATED APPLICATIONS

This application relates to co-pending U.S. patent application Ser. No. 08/021,366 entitled "Serpentine Avionics Fluorescent Tube With Enhanced Uniformity Of Luminance and Chromaticity" filed on even date herewith by the same inventor and assigned to the same assignee, which application is incorporated herein by reference in its entirety.

BACKGROUND OF THE INVENTION

The present invention generally relates to methods and apparatus for manufacturing serpentine fluorescent tubes, and more particularly concerns a method and apparatus for coating a fluorescent tube with a phosphor after the tube has been bent into a serpentine shape.

In today's aviation industry, avionics engineers are involved in continuing quest to improve the optical performance of avionics displays. One particular area of concern is fluorescent tubes for backlighting liquid crystal displays.

Typically, fluorescent lamps utilized in the avionics industry are serpentine and are constructed by coating the interior of transparent linear glass tubes with a fluorescent phosphor substance. The linear tubes are then later heated to the working temperature of the glass and are bent into the desired serpentine shape.

Another method to fabricate serpentine fluorescent lamps has been to bend transparent glass tubes into a "U" shape prior to coating with phosphors from the same type of phosphor slurry used to coat linear tubes. Success has been claimed for uniform deposition of phosphors from slurries onto "U" shaped tubing, but "S" shaped or "M" shaped tubes have not been uniformly coated with phosphor by the typical flush coat slurry method. In order to make "S" or "M" shaped tubes, it has been attempted to weld together 2 or 3 "U" shaped phosphor slurry coated tubes to create "S" and "M" shaped lamps respectively.

While these methods have been used widely in the past, all existing methods of fabricating serpentine lamps have several serious draw backs. First of all, in bend-after-coat schemes, the efficiency of the phosphors is diminished when they are heated to a temperature sufficient to allow bending of the tube. Secondly, the bending of the tube results in lacerations or cracks in the phosphor coating. This results in a diminution in luminance uniformity and chromaticity uniformity, as well as absolute luminance per unit area.

In the method involving welding several slurry coated "U" shaped tubes together, the areas where the "welding" occurs are exposed to high temperatures and the phosphor therein are degraded as a result.

Consequently, there exists a need for improved manufacture of fluorescent tubes for use in the avionics industry, in which phosphor efficiency and uniformity of luminance and chromaticity are not degraded as a result of the fabrication process.

SUMMARY OF THE INVENTION

It is an object of the present invention to provide improved methods and apparatus for manufacturing fluorescent tubes.

It is a feature of the method of the present invention to uniformly coat fluorescent tube with phosphors after the tube has been bent into a serpentine shape.

It is an advantage of the present invention to eliminate the cracking and lacerations and reheating of the phosphors which occurs upon bending of a previously coated fluorescent tube.

It is another object of the present invention to provide and apparatus for uniformly coating fluorescent tubes.

It is another feature of the present invention to provide a hose, nozzle and guide combination for pulling through a serpentine fluorescent tube.

It is another advantage of the present invention to uniformly apply the phosphor coating to a previously bent fluorescent tube.

The present invention is a method and apparatus for manufacturing fluorescent tubes, which is designed to satisfy the aforementioned needs, provide the previously propounded objects, include the above described features and achieve the already articulated advantages. The invention is carried out in a "non-phosphor coat bending method", in the sense that the incidental bending of the phosphor coat during the bending of a previously phosphor coated linear fluorescent tube is eliminated. Additionally, the invention is carried out in an "excessive heat exposure-less" method in the sense that the excessive and phosphor damaging heat exposure associated with bending or welding a pre-phosphor coated tube is eliminated. Instead, the hose, nozzle and guide combination of the present invention are utilized in the present inventive method to coat phosphors on an already bent tube.

Accordingly, the present invention relates to apparatus and method for uniformly coating phosphors onto a serpentine fluorescent tube by dragging a hose, nozzle and guide system through the serpentine fluorescent tube.

BRIEF DESCRIPTION OF THE DRAWINGS

The invention may be more fully understood by reading the following description of a preferred embodiment of the invention in conjunction with the appended drawing wherein:

The FIGURE is a cross-sectional representation of a serpentine fluorescent tube in the process of having a phosphor coat deposited thereon by the nozzle hose and guide combination of the present invention.

DETAILED DESCRIPTION

Now referring to the FIGURE, there is shown a fluorescent tube generally designated 200, having a first region 202 where a phosphor coat has already been deposited and a second region 204 where a phosphor coat is in the process of being deposited and third region 206 where no phosphor coat has yet been deposited. Also shown is a nozzle 210 which is coupled to hose 216 which is separated from the tube 200 by a plurality of spacers 214. Nozzle 210 sprays phosphors 212 against the tube creating a phosphor coating.

Preferrably, the phosphor 212 is pumped through the hose 216 and out nozzle 210. Preferrably, the phosphor coating is well known in the art and has been diluted with acetate/phalate lacquer to aid in the spraying process. The nozzle 210 is commercially available and preferrably provides a hollow cone spray pattern. Spacers 214 are preferrably cylindrical foam disks with a hole extending therethrough for receiving the hose 216. As the hose 216 is pulled out of the tube the nozzle 210 places pressure on the spacers 214 which causes them to be pulled through the tube. The plurality of these spacers 214 are utilized so that there can be relative movement between the spacers when there are being dragged around a bend in the tube. Preferrably, the spacers are resilient foam disks, however, other means maintaining a central displacement of the nozzle within the tube may be substituted. An alternative may be the protrusions or "fingers" that are used to self-center honing tools.

In operation, a fluorescent tube is bent into a serpentine shape and the hose spacer and nozzle combination is dragged through the tube while phosphors are being pumped out of the nozzle thereby coating the tube as the nozzle hose and spacers are dragged through the tube. As a result, no bending of the tube is necessary after the phosphor coat is applied. Further, the phosphors are not required to be exposed to a elevated temperature necessary for tube bending.

The term serpentine when used herein shall mean having at least two curved portions therein such as "S" or "M" shaped, but any shape with more than a single bend is contemplated.

The description herein has been focused upon coating serpentine shaped tubes. It is believed that the beneficial aspects of the present invention are more significant with serpentine tubes, but it must be understood that the method and apparatus of the present invention could be used on any shaped tube.

It is thought that the method and apparatus for manufacturing serpentine fluorescent tubes of the present invention and many of there attended advantages will be understood from the forgoing description and it will be apparent that various changes may be made in the form, construction, steps and arrangement of the parts and steps, without departing from the spirit and scope of the invention or sacrificing all of there material advantages, the form herein being merely preferred or exemplary embodiments thereof.

I claim:

1. A method for manufacturing serpentine fluorescent lamps comprising the steps:

providing a serpentine tube having a non-linear portion therein; and, dragging a hose having spacers disposed thereabout and nozzle which sprays a phosphor coating, through the non-linear portion of the serpentine fluorescent tube, thereby depositing a phosphor coating on the serpentine tube.

2. A method for manufacturing serpentine fluorescent lamps comprising the steps of:

providing a serpentine tube;

positioning a flexible hose, having a pump end and a nozzle end, through the serpentine tube;

coupling a nozzle to said nozzle end;

positioning a guide means about said flexible hose and between said nozzle and said pump end;

coupling a pump to said pump ends;

pumping phosphors through said flexible hose and out said nozzle; and, pulling said flexible hose and said nozzle, while pumping phosphors out the nozzle, through the serpentine tube;

whereby, the phosphors are caused to be coated on the serpentine shaped tube.

3. A method of claim 2 wherein said positioning a guide means, comprises placing a sponge disk having a hole in its center about the flexible hose.

4. A method of claim 2 wherein said positioning a guide means, comprises placing protruding fingers about the flexible hose.

5. A method of manufacturing fluorescent lamps comprising the steps of:

providing a tube having a non-linear portion therein;

positioning a flexible hose having spacers disposed thereabout, having a spray end and a pump end through the non-linear portion of the tube; and, coupling a pump to said pump end pumping phosphors through said hose and out said spray end while pulling said hose through said non-linear portion of said tube.

* * * * *